US006527283B1

(12) United States Patent
Bonaventure

(10) Patent No.: US 6,527,283 B1
(45) **Date of Patent: *Mar. 4, 2003**

(54) IN-LINE SKATE FRAME EQUIPPED WITH AN ANTI-TORSION BAR

(75) Inventor: Laurent Bonaventure, Cran Gevrier (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/420,812

(22) Filed: Oct. 19, 1999

(30) Foreign Application Priority Data

Oct. 20, 1998 (FR) ..... 98 13400
Apr. 30, 1999 (FR) ..... 99 05742

(51) Int. Cl.[7] ..... A63C 17/02
(52) U.S. Cl. ..... 280/11.221
(58) Field of Search ..... 280/11.19, 11.221, 280/11.223, 11.231, 11.232, 11.27

(56) References Cited

U.S. PATENT DOCUMENTS

| | | | | | |
|---|---|---|---|---|---|
| 578,081 | A | | 3/1897 | Gibbs et al. | |
| 593,278 | A | | 11/1897 | Moulton | |
| 2,168,820 | A | * | 8/1939 | Edstrom | 280/11.223 |
| 3,387,852 | A | | 6/1968 | De Sarro | 280/11.2 |
| 5,380,020 | A | | 1/1995 | Arney et al. | 280/11.22 |
| 5,388,846 | A | | 2/1995 | Gierveld | 280/11.22 |
| 5,403,021 | A | * | 4/1995 | Shifrin | 188/29 |
| 5,413,380 | A | * | 5/1995 | Fernandez | 280/11.19 |
| 5,549,310 | A | | 8/1996 | Meibock et al. | 280/11.22 |
| 5,575,489 | A | * | 11/1996 | Oyen et al. | 280/11.225 |
| 5,645,287 | A | | 7/1997 | Soo | 280/11.2 |

(List continued on next page.)

FOREIGN PATENT DOCUMENTS

| | | | | |
|---|---|---|---|---|
| DE | 29612212 | | 12/1996 | |
| EP | 43250 | A1 * | 1/1982 | A63C/17/06 |
| EP | 0774283 | | 5/1997 | |
| EP | 0795347 | | 9/1997 | |
| EP | 858821 | A2 * | 8/1998 | A63C/17/06 |
| EP | 876835 | A2 * | 11/1998 | A63C/17/00 |
| EP | 0925812 | | 6/1999 | |
| EP | 0936044 | | 8/1999 | |
| GB | 18312 | | of 1892 | |
| JP | 2001212280 | A * | 8/2001 | A63C/17/06 |
| WO | WO95/03101 | | 2/1995 | |
| WO | WO95/13120 | | 5/1995 | |
| WO | WO96/22818 | | 8/1996 | |
| WO | WO96/26775 | | 9/1996 | |
| WO | WO97/02072 | | 1/1997 | |
| WO | WO97/33665 | | 9/1997 | |
| WO | WO97/33666 | | 9/1997 | |
| WO | WO98/33565 | | 8/1998 | |

*Primary Examiner*—Daniel G. DePumpo
*Assistant Examiner*—Paul Royal, Jr.
(74) *Attorney, Agent, or Firm*—Greenblum & Bernstein, P.L.C.

(57) ABSTRACT

A frame of an in-line skate of the type constituted of a main body that includes a transverse base equipped with at least one front support surface for the boot and one rear support surface for the boot, each of these forming a U-shaped front platform and a rear platform by extending downwardly, either by two lateral projecting parts on which are attached two parallel independent flanges adapted to receive a series of wheels, or directly by the flanges when these flanges form a one-piece element with an upper transverse connecting portion, wherein the front and rear support surfaces of the boot are connected together by an intermediate arch in order to constitute an anti-torsion base for the frame and an element for transmitting forces.

40 Claims, 4 Drawing Sheets

U.S. PATENT DOCUMENTS 5,720,488 A 2/1998 Foffano et al. ..... 280/11.22
5,765,841 A * 6/1998 Johnson et al. ..... 280/11.221
5,775,706 A 7/1998 Caeran ..... 280/11.22
5,799,955 A 9/1998 Iverson ..... 280/11.22
5,803,466 A 9/1998 Wrike ..... 280/7.13
5,873,584 A * 2/1999 Wrike ..... 280/11.221
5,873,600 A * 2/1999 Conway ..... 280/816
5,915,703 A * 6/1999 Wrike ..... 280/11.231
5,997,014 A * 12/1999 Ellis et al. ..... 188/5
6,045,143 A * 4/2000 Wrike ..... 280/11.231
6,047,972 A * 4/2000 Rudolph ..... 280/11.19
6,053,512 A * 4/2000 Chang ..... 280/11.231 X
6,176,497 B1 * 1/2001 Bonaventure ..... 280/11.223
6,270,089 B1 * 8/2001 Marechal ..... 280/11.221

* cited by examiner

IN-LINE SKATE FRAME EQUIPPED WITH AN ANTI-TORSION BAR

BACKGROUND OF THE INVENTION

1. Field of the Invention

The invention is related to the field of in-line skates. More specifically, it relates to an improved frame for in-line skating.

2. Description of Background and Material Information

Normally, an in-line skate includes an assembly of various basic elements, including a boot that is fixed on a frame which in turn bears a series of aligned wheels. As such, the frame forms the interface between the boot and the wheels. The frame generally has platforms to receive the boot; these platforms connect the lateral walls that act as a support to the wheels. The frame withstands the bending and torsional forces that are applied by the skater. Consequently, it must be rigid enough to maintain a correct wheel alignment, both along the horizontal plane and the vertical plane in order to keep from sagging, twisting, or being laterally deformed while executing turns.

Currently, various types of frames exist. The most rigid, but also the most expensive to manufacture, are frames that are extruded and machined from metallic sections, generally made of aluminum. This provides a one-piece element with substantial rigidity which is particularly well adapted to competitive skating. The method for manufacturing such frames is described in U.S. Pat. No. 5,388,846, for example. In addition to the cost, there are other drawbacks related to the one-piece nature of the frame whereby there is little possibility for varying the mechanical characteristics, making the frame not very shock absorbent.

European Patent Publication No. 0 774 283 discloses a frame having separate lateral flanges, made by sheet metal stamping, that are then connected by platforms. The desired rigidity is provided by a frame rib having a predetermined size and location. However, manufacturing such a frame is still fairly expensive in view of the forming operations and the substantial amounts of aluminum needed.

Frames formed by two half-pieces made of an injected plastic material, connected together by complementary assembly means, are also well known. Generally speaking, these frames are the most economical to manufacture, but conversely, their mechanical characteristics are mediocre.

International Patent Publication No. WO 98/33565 is related to an in-line skate with an interface element arranged between the frame and the boot. The interface element is connected on the side of the frame by connection points located between the wheel axles and the frame platforms. This construction has the advantage of improving the transfer of forces between the boot and the frame. However, such a construction remains both complicated and expensive to obtain because it requires the design of an additional interface element and a frame made entirely of metal. The overthicknesses created between the frame and the interface also have a tendency to raise the boot with respect to a traditional construction; this is not desirable. These overthicknesses also increase the material costs and make the skate heavier.

European Patent Publication No. 0 795 347 discloses a frame having two longitudinally spaced blocks, connected to each other by sliding lateral rails. Such a construction allows the lengthwise adjustment of the frame depending on the various boot sizes. Nonetheless, such a frame has only mediocre rigidity due to its design which consists of two separate blocks.

U.S. Pat. No. 5,775,706 is related to a skate assembly having a boot, a frame with crosswise reinforcement elements and a pair of reinforcement angles connecting the front and rear axles of the frame to the sides of the boot. Such a construction promotes the transmission of forces from the boot to the wheels. However, this construction has the drawback of being complex in terms of both manufacture and assembly. In addition, such a construction is not adapted to be associated with a rapid disassembly system of the boot from the frame.

International Patent Publication No. WO 97/33665 is related to a frame for gliding sports articles whose structure consists of parts obtained from materials having different mechanical characteristics, attached to each other at least partially.

U.S. Pat. No. 5,803,466 is related to an in-line skate consisting of a frame equipped with a plate at the toe and a plate at the heel of the boot, to which are detachably attached independent lateral flanges. The flanges are inserted through two laterally spaced cavities and demarcated on each side of the frame by two pairs of edges extending downwardly from the lower surface of each plate. One of the main advantages is the ability to separate the flanges from the rest of the frame in order to replace or substitute them. Another advantage is to suggest a construction with intermediate plates that promote weight distribution in a way that reinforces the rigidity and resistance of the frame. However, such a construction does not provide for optimal mechanical characteristics because the flanges are simply retained by the edges and are independently blocked by independent screws. In addition, the assembly of such a frame appears to be lengthy and expensive due to the substantial number of elements, especially the affixing elements.

Various other frame designs are described in the following documents: U.S. Pat. Nos. 18,312; 578,081; 593,278; 2,168,820; 3,387,852; 5,380,020; WO 96/22818; U.S. Pat. No. 5,549,310; WO 96/22818; WO 97/02072; DE 296 12 212 U1; and WO 96/26775. However, all of these contructions are clearly different from the construction set forth in the instant invention.

SUMMARY OF THE INVENTION

It is thus an object of the invention to propose a frame structure that solves the problems of the prior art documents that have been cited hereinabove.

In particular, one of the objects of the invention is to propose a frame having good mechanical characteristics, especially good resistance and good rigidity, both in torsion and while bending, and promoting an optimal transmission of forces while skating.

Another object of the invention is to propose a frame whose very design enables the mechanical characteristics to be modulated by varying the nature of the materials and the sizes of its component elements.

Another object of the invention is to propose a frame having good mechanical characteristics while also limiting the number of elements used in the construction, as also its volume, and also limiting the use of costly raw materials by keeping their use restricted to the most appropriate areas.

Yet another object of the invention is to propose a frame that is capable of being adapted to any boot coupling system, especially to any detachable coupling system.

Another object of invention is to propose a frame whose design is both light and without overthicknesses while remaining rigid and inexpensive.

Another object of the invention is to propose a frame whose assembly is easy and requires a minimum number of operations.

A further object of the invention is to provide the possibility of facilitating the adaptation of the frame to various boot sizes and thus limiting the number of elements to be manufactured, thereby reducing manufacturing costs.

In order to achieve this, the invention is related to an in-line skate frame of the type constituted of a main body consisting of a transverse base equipped with at least one support surface at the toe of the boot and one support surface at the heel of the boot, each of these forming a front platform and a rear platform in the shape of a U and being extended downwardly, either by two projecting lateral portions on which are attached the two independent parallel flanges capable of receiving a series of wheels, or directly by the flanges when these flanges form a one-piece element with an upper transverse connecting portion, wherein the support surfaces at the toe and heel of the boot are connected to one another by an intermediate arch in order to form an anti-torsion base for the frame and an element for transmitting forces.

According to a second characteristic of the invention, the support surfaces at the toe and heel form substantially horizontal support planes, and are affixed together by an arch that is generally shaped like a convex arc extending longitudinally, in order to form a one piece sub-assembly adapted to be affixed to the lateral flanges by any connecting means, so as to constitute the frame.

The instant invention is also related to the characteristics that will become apparent from the following detailed description, and these ought to be taken either singly or as per all possible technical combinations thereof.

BRIEF DESCRIPTION OF DRAWINGS

This description, which has been provided as a non-restrictive example, will provide a better understanding of how the invention can be obtained with reference to the annexed drawings in which.

DETAILED DESCRIPTION OF THE INVENTION

Figure 1:
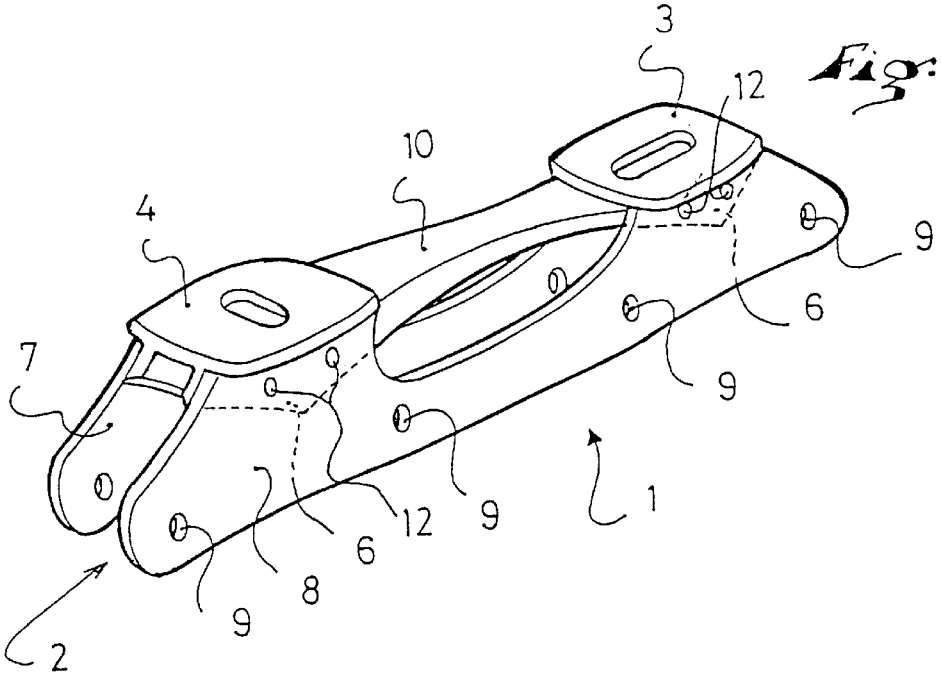
FIG. 1 is a perspective view of a frame according to a first embodiment of the invention.

The frame 1 of the invention includes a main body 2 having an upper transverse surface equipped with at least one support surface at the toe 3,—or a front support surface 3, a boot (not shown) and a support surface at the heel 4,—5 or rear support surface 4 for the same boot, each of these forming a front platform and a rear platform connecting the two flanges 7, 8, respectively, of the frame together and having, for this purpose, a downwardly extending U shape.

Figure 2:
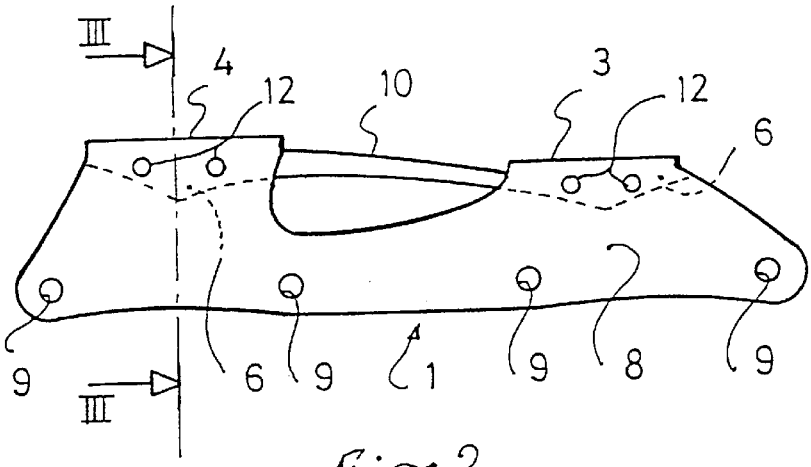
FIG. 2 is a side view of a frame according to FIG. 1, including a slight modification.
Figure 3:
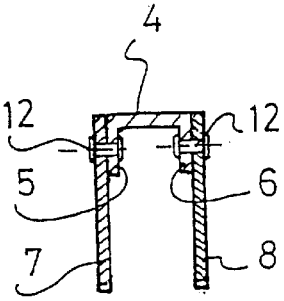
FIG. 3 is a transverse cross-sectional view along the line III—III of FIG. 2.

According to the embodiment of FIGS. 1 to 3, these extensions are obtained by two vertically projecting lateral portions 5 and 6 on which are attached the two parallel independent flanges 7 and 8 capable of receiving a series of wheels (not shown), the wheels being fixed due to the axles crossing the holes 9 of the flanges 7 and 8.

As described below, the extension of the heel and toe supports in the vertical direction can also be obtained directly by the flanges when they are obtained all in one-piece with an upper transverse connecting portion.

Similarly, the front and rear supports 3, 4 can be constituted of parallelepiped shaped blocks high enough for affixing the flanges.

In each of FIGS. 1–3, the uper extents of the two flanges 7, 8 overlap the exterior surfaces of the lateral portions 5, 6, respectively, of the supports 3, 4. However, FIGS. 2 and 3 illustrate a slight modification of the frame shown in FIG. 1. That is, in FIG. 1 the front and rear supports 3, 4 extend laterally beyond the flanges 7, 8, whereas in FIGS. 2 and 3 the entirety of the front and rar supports 3, 4 are contained between the flanges 7, 8.

Indeed, the support surfaces of the heel 4 and the toe 3 form substantially horizontal support planes, possibly offset heightwise, i.e., located at different levels, and are connected together fixedly by a longitudinal arch 10, this arch 10 preferably being generally obtained in the shape of a longitudinally extending convex arc, so as to form a one-piece sub-assembly capable of being affixed to the flanges 7 and 8 by any connecting means, so as to constitute the frame 1. It can also have a completely rectilinear shape, the main thing being that it forms a connecting beam for the support surfaces 3, 4 and provides rigidity to the frame in torsion.

Continuing with the embodiment of FIGS. 1, 2, and 3, the flanges 7 and 8 are attached on both sides of the outer surfaces of an inverted U formed by the lateral projecting portions 5, 6, and are therefore connected together by the arch and the front and rear supports 3, 4.

Figure 4:
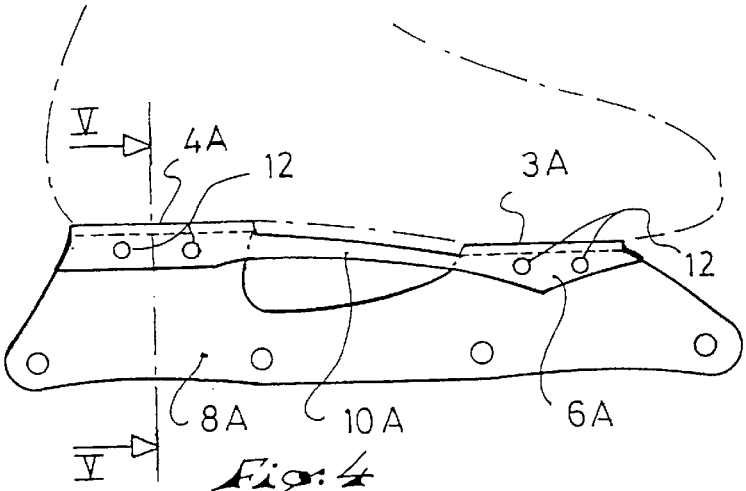
FIG. 4 is a side view of a frame according to a second embodiment.
Figure 5:
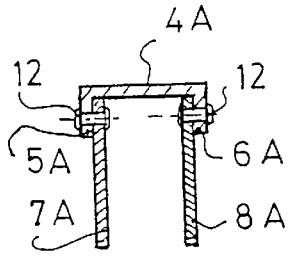
FIG. 5 is a transverse cross-sectional view along line V—V of FIG. 4.

The embodiment of FIGS. 4 and 5 essentially differs from the previous one in that the flanges 7A, 8A are attached on the inner surfaces of the U formed by the inner surfaces of the lateral projecting portions 5A, 6A, and the front and rear supports 3A, 4A are connected together by the arch 10A.

Figure 6:
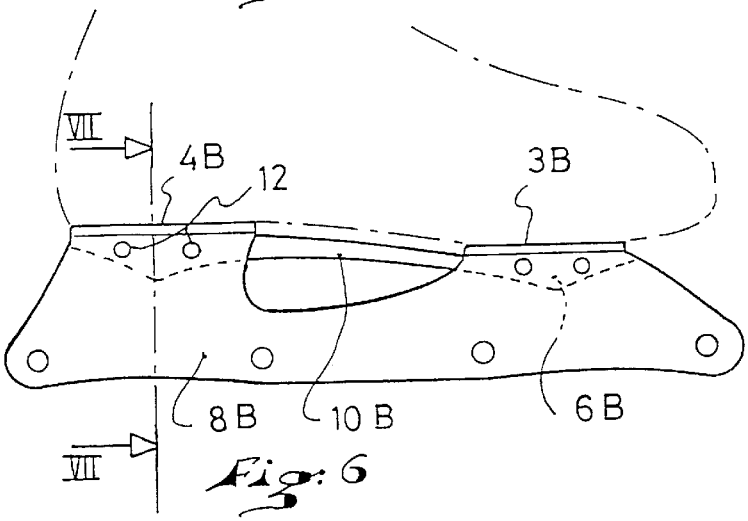
FIG. 6 is a side view of a frame according to a third embodiment.
Figure 7:
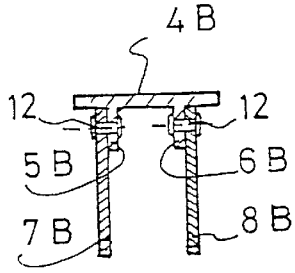
FIG. 7 is a transverse cross-sectional view along line VII—VII of FIG. 6.

The embodiment represented in FIGS. 6 and 7 mainly differs from the one represented in FIGS. 1 to 3 in that the flanges 7B, 8B are attached on both sides of the outer surfaces of an inverted U formed by the vertically projecting lateral portions 5B, 6B of the front and rear supports 3B, 4B, which are connected together by the arch 10B. The upper support surfaces of the supports 3B, 4B horizontally exceed the flanges 7B, 8B on both sides thereof so as to enable them to be adapted to wide boots.

According to the above-cited embodiments, the arch 10, 10A, 10B is obtained according to a section shaped like an inverted U whose free arms are directed downwardly. It can also be constituted of a section having a different shape and having transverse stiffening ribs.

This arch in fact constitutes a longitudinal bridge connecting the front 3 and rear 4 supports and constitutes an anti-torsion stiffening bar and a bar for transmitting forces between the front and the rear.

Figure 8:
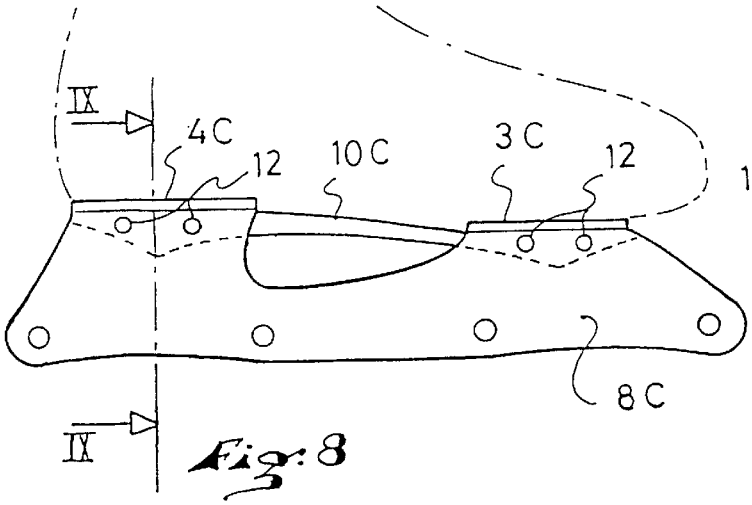
FIG. 8 is a side view of a frame according to a fourth embodiment.
Figure 9:
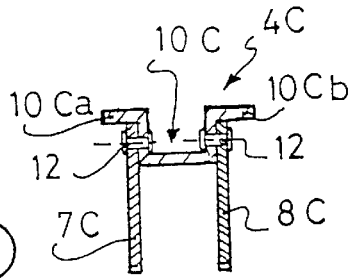
FIG. 9 is a transverse cross-sectional view along line IX—IX of FIG. 8.

The embodiment represented in FIGS. 8 and 9 mainly differs from the previous embodiments in that the flanges 7C, 8C are attached on both sides of the outer surfaces of the vertical arms of a U forming the arch 10C. The vertical arms are directed upwardly so as to be extended, in the zone of the heel 4 and of the toe 3 of the boot, by horizontal wings 10Ca and 10Cb projecting outwardly according to an inverted Ω shape, so as to constitute the corresponding support surfaces 3C, 4C of the boot, which are connected together by the arch 10C.

The advantage of this variation is the ability to obtain the arch 10C and its end supports 3C and 4C by embossing during a stamping operation.

Figure 10:
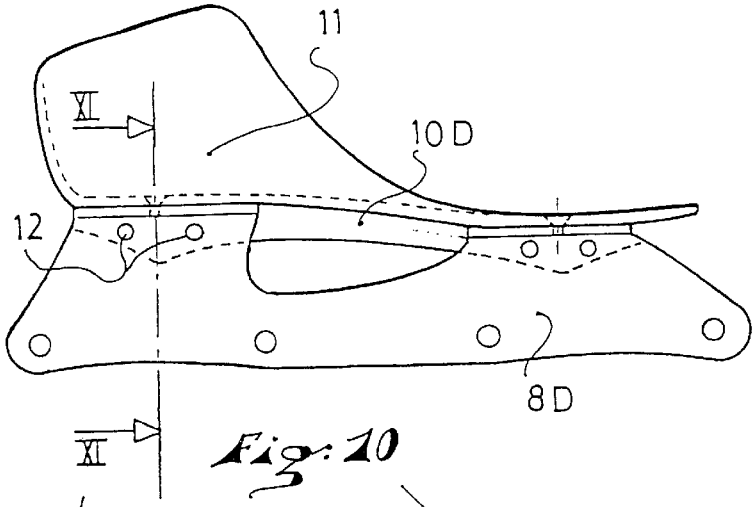
FIG. 10 is a side view of a fifth embodiment of the invention.
Figure 11:
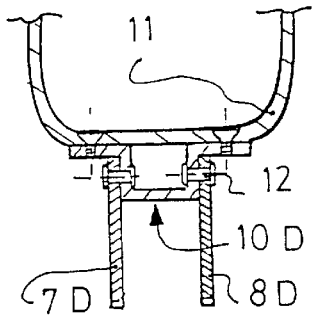
FIG. 11 is a cross-sectional view along line XI—XI of FIG. 10.

The embodiment of FIGS. 10 and 11 is basically different from the embodiment of FIGS. 8 and 9 in that the arch 10D—heel 4 and toe 3 support assembly is fixed on a substantially rigid cradle or sole 11 of the boot, the arch 10D being substantially rectilinear, so as to correspond to the plane of the cradle 11 and thus stiffen both the cradle and the flanges 7D, 8D for maximum efficiency.

According to all the embodiments cited hereinabove, the flanges 7 and 8, or 7A, 8A, or 7B, 8B or 7C, 8C or 7D, 8D are obtained preferably by stamping. Other manufacturing methods can also be used, depending upon the materials used. Also, generally speaking, the means for connecting these flanges on the front and rear supports 3, 4, 3A, 4A, 3B, 4B, 3C, 4C, 3D, 4D are obtained by means of lateral rivets 12 which constitute the aforementioned-cited connecting means.

Figure 12:
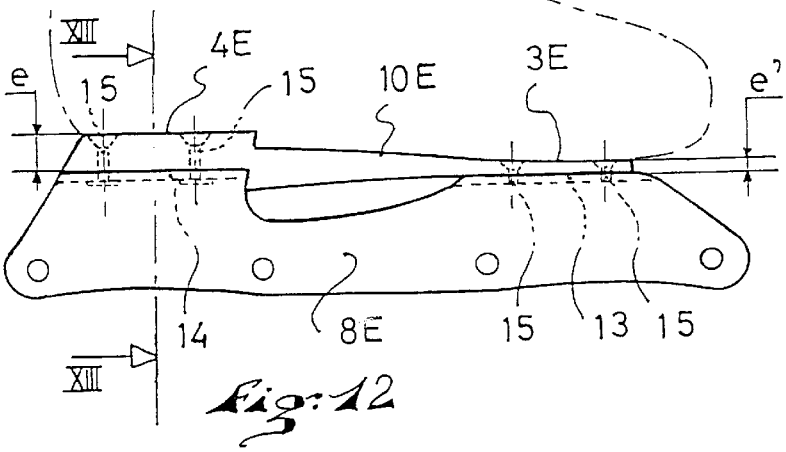
FIG. 12 is a side view of a frame according to a sixth embodiment.
Figure 13:
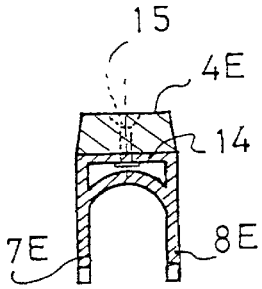
FIG. 13 is a cross-sectional view along line XIII—XIII of FIG. 12.

The embodiment variation represented in FIGS. 12 and 13 basically differs from the previous embodiments in that the flanges 7E, 8E constitute a one-piece element with the front 13 and rear 14 upper transverse connecting portions in an inverted U configuration. In this case, the upper heel and toe 4E, 3E support surfaces connected by the arch 10E are attached on the front 13 and rear 14 transverse portions by any known connecting means.

According to this variation, these connecting means can be constituted by rivets 15 engaged vertically from the top of the frame, or even by screws.

According to this same embodiment, the frame formed by the flanges 7E, 8E and their transverse portions 13 and 14 is obtained by extrusion, followed by machining.

Still according to the embodiment of FIGS. 12 and 13, the heel support 4E of the boot has a thickness "e" that is greater than the thickness "e'" of the toe support 4E "e'" so as to stiffen and raise the heel of the boot.

In this case, the extrusion die of the frame base section is simplified because the transverse portions 13 and 14 are aligned. The portions 13, 14 can also be provided at different levels in the extrusion section.

The arch 10E can be mounted both on the inside, at the rear of the frame, or on the outside at the front of this same frame, or vice-versa.

Figure 14:
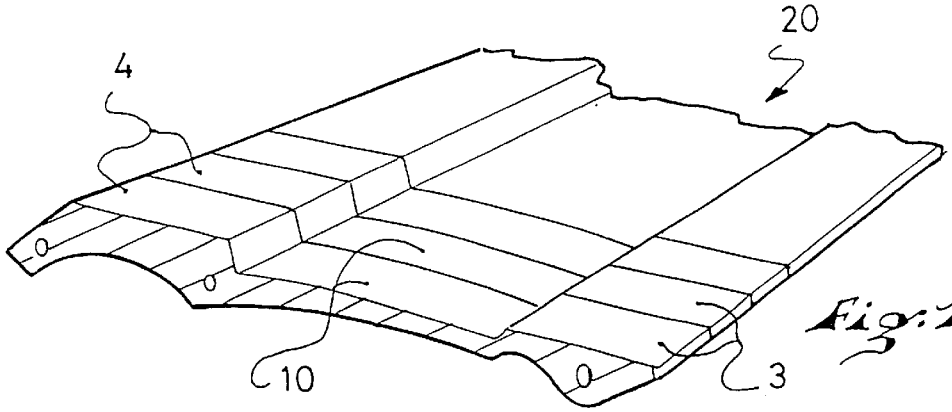
FIG. 14 is a perspective view of a section from which the anti-torsion bar constituting the arch can be obtained according to the aforementioned embodiments.

As shown in FIG. 14, the toe 3 and heel 4 supports that are connected to the arch 10 can be obtained during the same cutting operation of an extruded bar having a corresponding profile.

Also, according to an improvement of the invention, the arch 10 for connecting the toe 3 and heel 4 supports is asymmetrical so as to be adapted to the recess of a foot.

Figure 15:
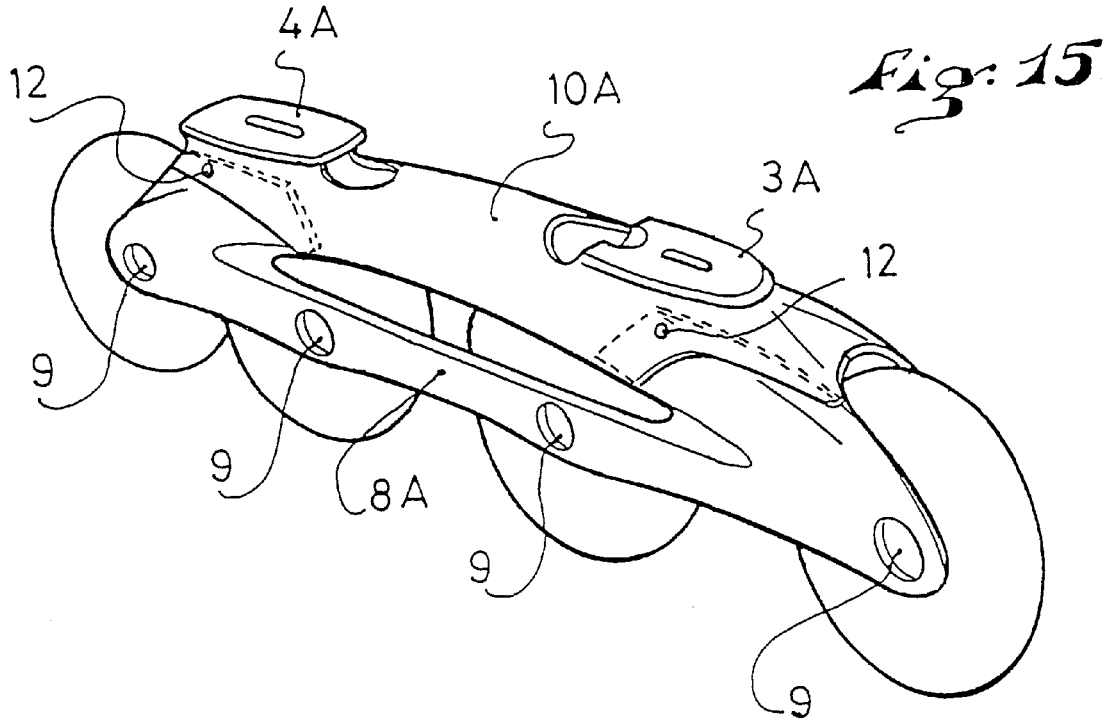
FIG. 15 is a perspective view illustrating a variation of the second embodiment according to FIGS. 4 and 5.

FIG. 15 represents an adapted illustration relating to schematic views of the embodiment of FIGS. 4 and 5, and shows a preferred shape that could be given to an arch 10A according to one of the embodiments of the invention. In this case, the arch 10A is also sectioned in the transverse direction for even greater rigidity in torsion.

This in itself is another important advantage of the invention which allows for the infinite declination in the shape of this arch, and consequently, of the frame, thus allowing the range of articles on the base to be increased. This arch and the front and rear supports can be obtained by injection molding a metallic or plastic material. This could be aluminum, carbon, any plastic material or even titanium or magnesium. When a plastic material is used, it can be fiber reinforced so as to obtain a reinforcement of the material.

This element can also be obtained by machining an extruded bar, as mentioned earlier and represented in FIG. 14.

Figure 16:
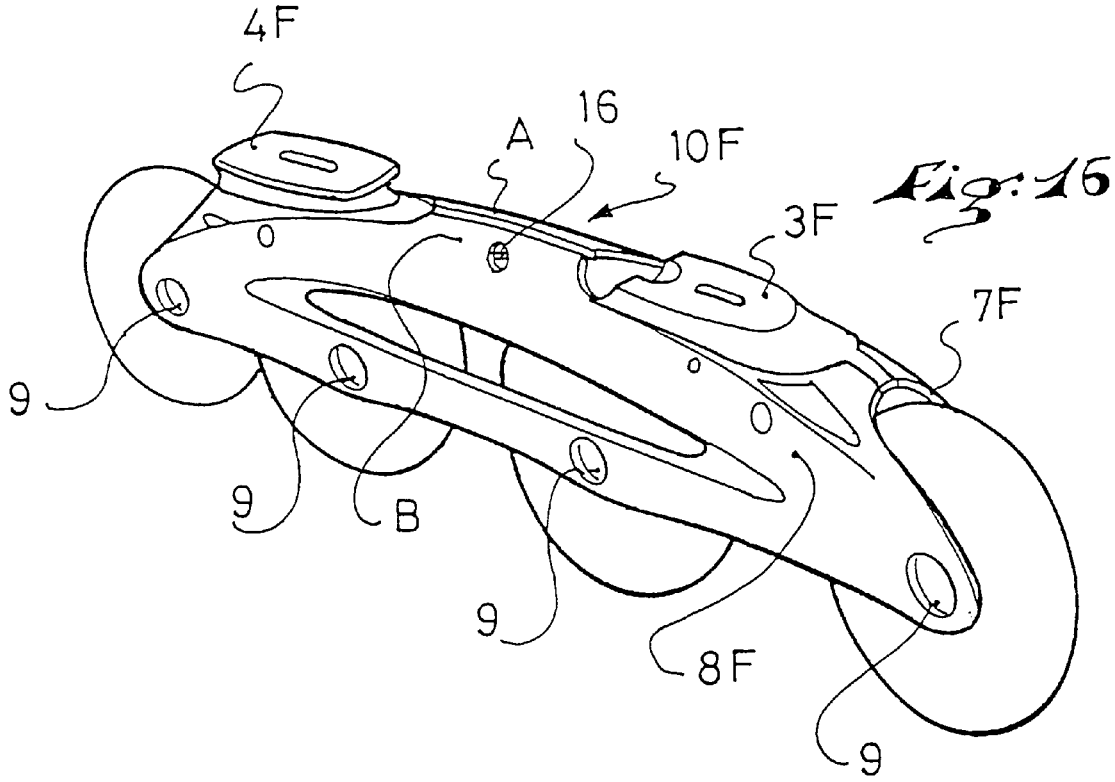
FIG. 16 is a perspective view of a frame according to a seventh embodiment of the invention.

The embodiment variation represented in FIG. 16 mainly differs from the previous embodiments in that the connection of the heel 4F and toe 3F supports is obtained by means of flanges 7F, 8F that be extended transversely towards one another at their upper central portions A–B without being joined, in order to form the arch 10F.

Indeed, in the previous examples, the issue was to obtain an arch forming a longitudinal torsion bar by a longitudinal bridge, whereas in the latter case, the torsion bar is constituted of a transverse bridge forming the arch 10F.

The torsion adjustment can be obtained by adjustment screws 16 crossing the two portions constituting this arch 10F.

The invention is not limited to the specific embodiments described herein, but encompasses all embodiments implementing similar or equivalent technical means.

What is claimed is:

1. A frame for an in-line skate constituted of a main body comprising a transverse base equipped with at least one front foot support and one rear foot support, said front foot support forming a U-shaped front platform and said rear foot support forming a U-shaped rear platform by downwardly and longitudinally extending lateral portions, said lateral portions of each of said front and rear U-shaped platforms being positioned on opposite lateral sides of said front and rear U-shaped platforms, said frame further comprising a pair of independent flanges, each of said flanges affixed to and extending downwardly from said lateral portions of respective lateral sides of said front and rear platforms, and said frame further comprising an intermediate arch rigidly connecting together said front and rear foot supports and said pair of independent flanges, in order to constitute an anti-torsion base for the frame and an element for transmitting forces.

2. A frame according to claim 1, wherein the front and rear foot supports comprise substantially horizontal support surfaces, said front and rear foot supports being fixedly connected together by the arch.

3. A frame according to claim 1, wherein the arch has the overall shape of an upwardly projecting convex arc extending in the longitudinal direction.

4. A frame according to claim 1, wherein the flanges are attached on both sides of outer surfaces of the lateral portions of the front and rear foot supports connected together by the arch.

5. A frame according to claim 1, wherein the flanges are attached on inner surfaces of the lateral portions of the front and rear foot supports connected together by the arch.

6. A frame according to claim 1, wherein the flanges are attached on both sides of outer surfaces of the lateral portions of the front and rear foot supports connected together by the arch, each of the front and rear foot supports including upper support surfaces extending horizontally outwardly from the flanges on both sides of the flanges.

7. A frame according to claim 1, wherein the arch comprises a U-shape having free arms directed downwardly.

8. A frame according to claim 1, wherein the arch comprises a U-shape having free arms directed upwardly, the flanges being attached on outer surfaces of the free arms of the U-shaped arch, said front and rear foot supports comprising an inverted Ω-shape, said inverted Ω-shape comprising horizontal wings extending from respective longitudinal extensions of said arms of said arch in front and rear zones support zones of the boot.

9. A frame according to claim 1, wherein an assembly constituted by the arch, said front foot support, and said rear foot support is fixed on a sole of the boot, the arch corresponding to the plane of the sole so as to stiffen both the sole and the frame.

10. A frame according to claim 1, wherein the arch, connecting the front and rear foot supports, is asymmetrical in order to be adapted to the recess of a foot.

11. A frame according to claim 1, wherein the arch connecting the front and rear foot supports is obtained by means of extensions of the flanges of the frame, said extensions extending transversely towards one another an upper central portion without being joined.

12. A frame according to claim 1, wherein the arch is obtained by injection molding a metal or plastic material.

13. An in-line skate comprising a frame according to claim 1, and further comprising a boot affixed to the frame and a series of wheels rotatably secured to the frame.

14. A frame according to claim 1, wherein said flanges include holes for mounting a series of in-line wheels between said flanges.

15. A frame according to claim 7, wherein the free arms of the arch are co-extensive with respective ones of said lateral portions of both said front and rear platforms.

16. A frame according to claim 7, wherein the free arms of the arch are unitary with respective ones of said lateral portions of both said front and rear platforms.

17. A longitudinally extending frame for an in-line skate, said frame comprising:

a front foot support, for supporting a front of a foot, said front foot support including a pair of downwardly and longitudinally extending transversely spaced-apart front lateral portions;

a rear foot support for supporting a rear of the foot, said fear foot support including a pair of downwardly and longitudinally extending transversely spaced-apart rear lateral portions;

a pair of independent flanges, each of said flanges rigidly affixed to and extending downwardly from and downwardly beyond one of said front lateral portions of said front foot support and one of said rear lateral portions of said rear foot support;

a longitudinally extending intermediate arch rigidly connecting together said front and rear foot supports and said pair of independent flanges, said arch constituting an anti-torsion bar for providing torsional rigidity to the frame and for transmitting forces between said front and rear foot supports.

18. A frame according to claim 17, wherein:

said arch, said front boot support, and said rear boot support forming a unitary construction.

19. A frame according to claim 17, wherein:

said pair of independent flanges are non-unitary with respect to each other.

20. A frame according to claim 18, wherein:

said pair of independent flanges are non-unitary with respect to each other.

21. A frame according to claim 17, wherein:

each of said pair of independent flanges are affixed to said front and rear lateral portions of said front and rear foot supports by means of a plurality of discrete connecting elements.

22. A frame according to claim 21, wherein:

said discrete connecting elements comprise transversely extending rivets.

23. A frame according to claim 17, wherein:

each of said pair of independent flanges consists of generally vertically extending elements rigidly affixed to lateral surfaces of said front and rear lateral portions of said front and rear foot supports.

24. A frame according to claim 17, wherein:

said front and rear foot supports include substantially horizontal support surfaces, said front and rear foot supports being fixedly connected together by said arch.

25. A frame according to claim 17, wherein:

said arch has a longitudinally extending and upwardly projecting convex shape.

26. A frame according to claim 17, wherein:

said flanges are affixed to outer lateral surfaces of said lateral portions of said front and rear foot supports.

27. A frame according to claim 17, wherein:

said flanges are affixed on inner lateral surfaces of said lateral portions of said front and rear foot supports.

28. A frame according to claim 17, wherein:

said flanges are affixed on of outer surfaces of both sides of said lateral portions of said front and rear foot supports, each of said front and rear foot supports including upper support surfaces extending horizontally outwardly beyond both sides of said flanges.

29. A frame according to claim 17, wherein:

said arch comprises a U-shape having free arms directed downwardly.

30. A frame according to claim 17, wherein:

said arch comprises a U-shape having free arms directed upwardly, said flanges being attached on outer surfaces of said free arms of the U-shaped arch, said front and rear foot supports comprising an inverted Ω-shape, said inverted Ω-shape comprising horizontal wings extending from respective longitudinal extensions of said arms of said arch in front and rear zones support zones of the boot.

31. A frame according to claim 17, wherein:

an assembly constituted by said arch, said front foot support, and said rear foot support is fixed on a sole of the boot, said arch corresponding to a plane of the sole so as to stiffen both the sole and the frame.

32. A frame according to claim 17, wherein:

said arch, connecting the front and rear foot supports, is asymmetrical in order to be adapted to the recess of a foot.

33. A frame according to claim 17, wherein:

said arch connecting said front and rear foot supports is obtained by means of extensions of said flanges of the frame, said extensions extending transversely towards one another at an upper central portion without being joined.

34. A frame according to claim 17, wherein:

said arch is obtained by injection molding a metal or plastic material.

35. A frame according to claim 17, wherein:

said flanges include holes for mounting a series of in-line wheels between said flanges.

36. A frame according to claim 29, wherein:

said free arms of said arch are co-extensive with respective ones of said lateral portions of both said front and rear platforms.

37. A frame according to claim 29, wherein:

said free arms of said arch are unitary with respective ones of said lateral portions of both said front and rear foot supports.

38. An in-line skate comprising a frame according to claim 17, and further comprising:

a boot affixed to the frame and a series of wheels rotatably secured to the frame.

39. A frame according to claim 1, further comprising a plurality of wheels, and wherein:

said flanges include a series of pairs of co-axial holes, each of said wheels being mounted between said flanges along an axis of a respective one of said pairs of holes.

40. A frame according to claim 17, further comprising a plurality of wheels, and wherein:

said flanges include a series of pairs of co-axial holes, each of said wheels being mounted between said flanges along an axis of a respective one of said pairs of holes.

* * * * *